United States Patent [19]

Shimizu et al.

[11] 4,307,557

[45] Dec. 29, 1981

[54] CAPPING MACHINE FOR APPLICATION OF SEALING CAPS TO BUNGS OF LIQUID CONTAINERS

[75] Inventors: Isekazu Shimizu, Nagoya; Kuniaki Tamura, Tokyo; Minoru Takahashi, Tokyo; Masahiro Kobayashi, Tokyo; Katuhiro Watanabe, Tokyo; Hiroshi Nishidome, Saitama; Hidetoshi Furuya, Yamato; Minoru Yonaga, Yokohama, all of Japan

[73] Assignee: Asahi Breweries Ltd., Tokyo, Japan

[21] Appl. No.: 210,927

[22] Filed: Nov. 28, 1980

Related U.S. Application Data

[63] Continuation-in-part of Ser. No. 132,250, Mar. 20, 1980, which is a continuation of Ser. No. 909,127, May 24, 1978, abandoned.

[30] Foreign Application Priority Data

Jul. 1, 1977 [JP] Japan ..... 52-78899

[51] Int. Cl.[3] ..... B65B 7/28; B65B 61/26

[52] U.S. Cl. ..... 53/131; 53/248; 53/307; 53/309

[58] Field of Search ..... 53/131, 248, 306, 307, 53/309; 279/4; 221/251, 278, 307

[56] References Cited

U.S. PATENT DOCUMENTS

| | | | |
|---|---|---|---|
| 2,647,670 | 8/1953 | Cox | 53/248 X |
| 2,701,085 | 2/1955 | Davis | 53/248 X |
| 2,833,095 | 5/1958 | Stuart | 53/248 |
| 3,099,120 | 7/1963 | Bruun | 221/278 X |
| 3,293,823 | 12/1966 | Anderson | 53/131 |
| 3,415,034 | 12/1968 | Schmitt | 53/307 X |
| 3,422,597 | 1/1969 | Beer | 53/307 X |
| 3,487,622 | 1/1970 | Mueller | 53/307 X |
| 3,511,025 | 5/1970 | Newport | 53/307 |
| 3,516,681 | 6/1970 | Cox et al. | 279/4 |
| 3,542,354 | 11/1970 | Fitzpatrick | 279/4 X |
| 3,663,027 | 5/1972 | Klipping | 279/4 |
| 3,712,023 | 1/1973 | Beyan, Jr. et al. | 53/307 |
| 4,057,454 | 11/1977 | Smith et al. | 279/2 A X |
| 4,065,909 | 1/1978 | Mueller | 53/129 X |

FOREIGN PATENT DOCUMENTS

| | | | |
|---|---|---|---|
| 839548 | 4/1939 | France | 53/307 |

*Primary Examiner*—John Sipos

*Attorney, Agent, or Firm*—Blanchard, Flynn, Thiel, Boutell & Tanis

[57] ABSTRACT

A capping machine for application of sealing caps which cover the bungs of a variety of liquid containers which comprises a cap holder with a vertical cylindrical shape in which a plurality of sealing caps is piled up with the upward open ends to form a cylinder, a horizontal circular band made of a resilient material which is arranged at the bottom of the cap holder, making the internal surface thereof identical to that of the cap holder, a pneumatic system which intermittently inflates the internal surface of the resilient circular band toward the center thereof, a sucking member which takes down and holds a sealing cap located at the extreme bottom of the sealing cap pile in the cap holder during the period in which the resilient band holds a sealing cap second to the bottom, and a means which changes the direction of and carries sealing cap held by the sucking member and applies the same to a bung of a liquid container.

1 Claim, 11 Drawing Figures

FIG. 1
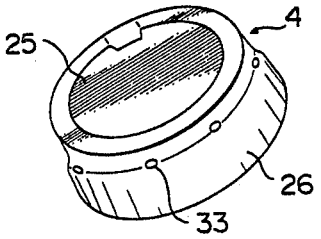
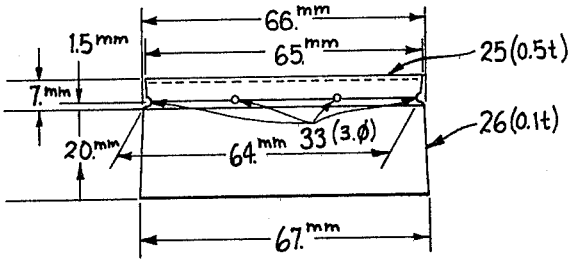
FIG. 1A

TIME SEQUENCE OF CIRCUITRY
(BROKEN LINES SHOW TIME LAG.
CROSS HATCHING PART SHOWS ONCE FAULT OF CAP SEPERATING)

CAPPING MACHINE FOR APPLICATION OF SEALING CAPS TO BUNGS OF LIQUID CONTAINERS

This is a continuation-in-part of application Ser. No. 132,250 filed Mar. 20, 1980, which in turn is a continuation of application Ser. No. 909,127, filed May 24, 1978 now abandoned.

BACKGROUND OF THE INVENTION

This invention relates to a capping machine which applies sealing caps to the bungs of a variety of liquid containers for protection of the bungs and the nearby portion from contamination by a variety of the foreign materials.

In the prior art, after being filled up with liquid product such as draught beer, the bungs as well as the immediate nearby portion is covered with sealing caps for protection of the portion from contamination by a variety of foreign materials. Application of such sealing caps is carried out by man power. In other words, a laborer picks up sealing caps, one by one, out of the storage in which they are usually piled up to form a cylinder, applies each of them on top of the bungs after stamping the date and/or some other indications on each of them, if necessary, and sprays steam or hot water onto each of them to cause them to shrink, whereby the portion is covered by sealing caps in a tight condition.

It is evident that this type of manual operation is nonproductive, inefficient and undesirable particularly from the hygienic viewpoint.

SUMMARY OF THE INVENTION

A general object of this invention is to provide a full automatic capping machine for application of sealing caps to the bungs of liquid containers which is completely free from a variety of failures inherently unavoidable in the prior art such as less productivity, inefficiency and the undesirable condition from the hygienic viewpoint.

A further, more specific, object of this invention is to provide a full automatic, efficient and failure-free capping machine for application of sealing caps to the bungs of liquid containers which comprises a cap holder with a vertical cylindrical shape in which a plurality of sealing caps is piled up with the upward open ends, a horizontal circular band made of a resilient material which is arranged at the bottom of the cap holder, making the internal surface thereof identical to that of the cap holder, a pneumatic system which intermittently inflates the internal surface of the resilient circular band toward the center thereof, a sucking member which sucks the under surface of a sealing cap located at the extreme bottom in the cap holder to take down and hold the same during the period in which the resilient circular band holds a sealing cap second to the bottom, and a means which changes the direction of the sealing cap held by the sucking member to make it face downward and carries and applies the same on top of the bung of a liquid container, whereby a sealing cap located at the extreme bottom of the sealing cap pile in the cap holder can be taken out without fail without manpower with high productivity and efficiency.

Another object of this invention is to provide a capping machine for application of sealing caps to bungs mentioned in the above in which both the means to provide the vertical motion and the rotation for the sucking member are air cylinders, whereby all the motions are provided by the single air pressure supply and no other energy supplies are required.

An additional object of this invention is to provide a capping machine for application of sealing caps to bungs mentioned in the above, further provided with a printing member and an ink pad for printing the date and/or some other indications on sealing caps during the period in which the sealing caps are held by the sucking member, eliminating the troublesome job of stamping the indications on the sealing caps applied to the bung, and additionally designed to provide all the energy supply from the single air pressure supply, requiring no other energy supply.

Other objects, features and advantages will be pointed out in, or be apparent from, the specification and claims, as will obvious modification of the embodiment shown in the drawings, in which:

BRIEF DESCRIPTION OF THE DRAWINGS

FIG. 1 is a perspective view of a type of sealing cap to be applied to the bung of a liquid container with a capping machine in accordance with this invention, FIG. 1A is a front elevational view of a cap of the FIG. 1 type.

DETAILED DESCRIPTION OF THE PREFERRED EMBODIMENT

Figure 2:
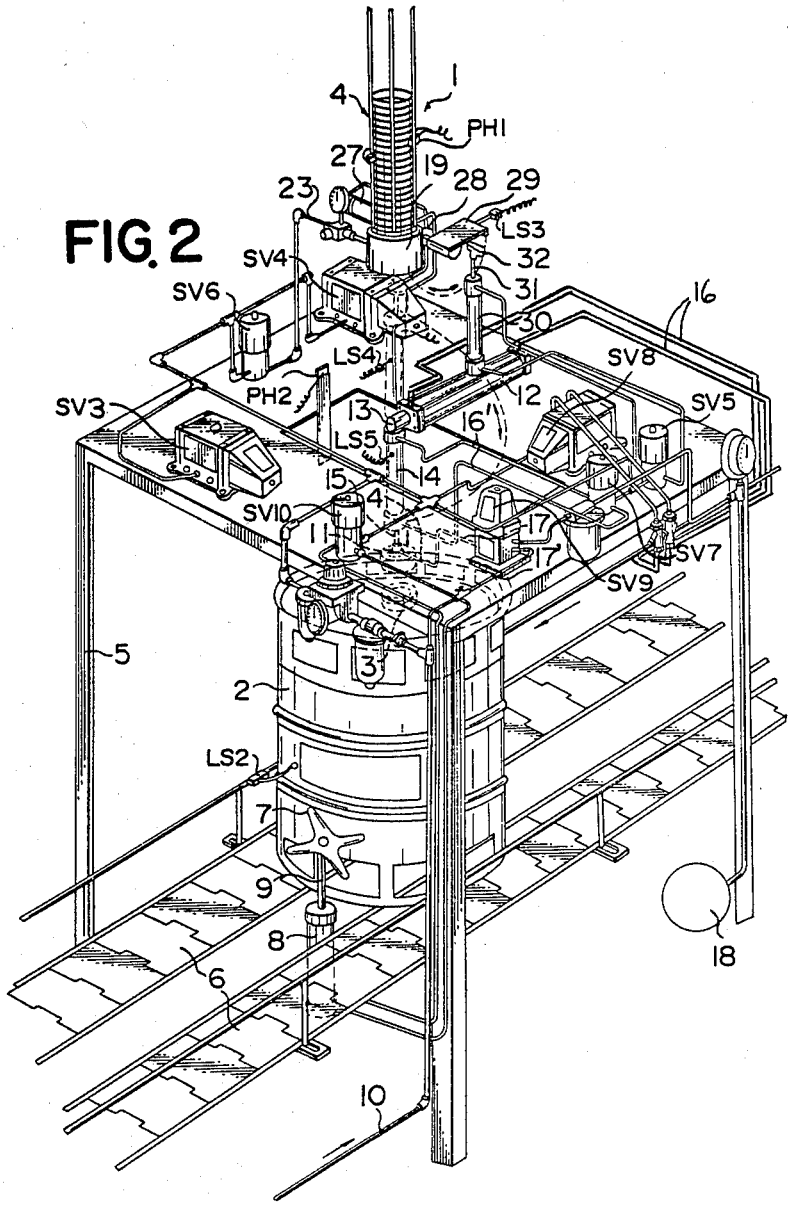
FIG. 2 is a perspective view of an embodiment in accordance with this invention.

With particular reference to the drawings, a capping machine for application of sealing caps to the bungs of liquid containers, specifically of the barrels for draught beer, is illustrated as incorporated in a product filling line.

FIG. 1 shows a sealing cap 4 to be applied to the bungs of the barrels for draught beer, a typical sealing cap to be applied to the bungs of liquid containers with the capping machine in accordance with this invention. Referring to FIGS. 1 and 1A, the sealing cap 4 comprises a noncontractive and relatively hard plane head plate 25 and a side wall portion 26 made of soft thermocontractive polyvinyl chloride and connected to the lower portion of said plate. The side wall portion 26 is relatively thin (0.1 mm. thick in the example shown in FIG. 1A) and hence is pliable and readily pushed out of shape. The wall portion 26 is of a downwardly enlarged truncated conical shape, and is provided, at the portion close to the top, with a stepped portion having a plurality of air passages 33 arranged therealong. The cap 4 as aforesaid is inverted and piled up as shown in FIGS. 3 and 6–8.

The head portion 25' of the cap 4' second to the bottom is supported at its circumferential edge on the inner circumferential edge arranged along the stepped portion of the cap 4 located at the extreme bottom of the cap pile and at the same time the outer circumference of the side wall 26' is supported on the inner circumference of the side wall 26, whereby a required space is formed between the nested caps 4 and 4'. A plurality of caps 4 are thus piled up to form a tubular body as shown in FIG. 2, to be conveyed and stored in this form.

As described hereinafter, when the bottommost cap 4 is removed from the cap pile by means of a sucking member 11 as shown in FIGS. 3 and 6–8, air is supplied by the air passages 33 of the cap 4 into the space between the bottommost cap 4 and the cap 4' located second to the bottom, and due to this air supplied the cap 4 by itself is allowed to separate readily from the cap pile without being followed by the next cap 4'. Thus, the plurality of air passages 33 arranged along the stepped portion of the truncated conical portion 26 make it easy to remove each sealing cap from the sealing cap pile which is the usual position in which sealing caps are stored and/or transported until each of them is applied to the bungs of a liquid container, as shown in FIG. 2.

Referring to FIG. 2 showing a capping machine for application of sealing caps to the bungs of liquid containers incorporated in a draught beer filling line which fills up a barrel 2 with draught beer, a couple of conveyors 6, with a desirable distance between each other, runs under a frame 5 to convey draught beer barrels 2. A stopper 7 is arranged to position each barrel 2 at an appropriate position along the conveyor 6. The stopper 7 is actuated upward or downward beyond the conveyor surface by a rod 9 of an air cylinder 8, which is connected with a main pneumatic tube 10 through a connecting tube.

A sucking member 11 which sucks the under surface of sealing caps is arranged on the frame 5. The sucking member 11 is fitted at one end of the rod 15 of a reciprocating air cylinder 14 fitted at a right angle on the rotatable shaft 13 of a rotary air cylinder 12 supported by the frame 5. The rotary air cylinder 12 rotates the reciprocating air cylinder 14 through 180 degrees between the upward and downward positions. Further, the reciprocating air cylinder 14 moves the sucking member upward and downward at each of the upward and downward positions referred to above.

Connecting tubes 16 and 16' (containing solenoid valves hereafter discussed) are employed to connect the air cylinders 12 and 14 with the main pneumatic tube 10. A connecting tube 17 is employed to connect the sucking member 11 and a vacuum pump 18, and a connecting tube 17' is employed to connect the sucking member 11 and the main pneumatic tube 10 to blow out the air and the suction or blowing out thereof is switched by means of a solenoid valve SV-9.

A cap holder 19 is arranged at the highest position in a zone in which the sucking member 11 is allowed to move. As seen from FIG. 3, this cap holder 19 includes an upper cylindrical member 35 and a lower cylindrical member 36 with an internal surface 24 and 24' whose inside diameter is about 2–3 mm. greater than the outside diameter of the upper portion of the truncated conical portion of the cap 4. Said members 35 and 36 are threaded together, and an annular recess 20 is formed between the lower end line of the member 35 and the corresponding upper end line of the stepped portion of the member 36. In this annular recess 20 is received an annular member 38 of lesser width and height than the annular recess 20, and a cavity is formed between the upper and lower walls of the recess 20 and the member 38. In this cavity is disposed a resilient rubberlike band 21, and the annular member 38 is surrounded by the upper and lower horizontal flange portions of the band and the vertical portion thereof connecting said flanges. The surface of the vertical portion of said band 21 is substantially in line with the inside surfaces 24 and 24' of the members 35 and 36. The member 36 is connected with a connecting tube 23 which is further connected with the main pneumatic tube 10, and is also provided with an air supply hole which communicates with the connecting tube 23. The radially inside and outside wall surfaces of the member 38 opposed to said air supply hole have annular recesses which communicate through connecting openings 40 in member 38.

When compressed air is supplied into the circular hollow space 22 from the main pneumatic tube 10 through connecting tube 23, the internal surface of the resilient circular band 21 inflates toward the center thereof beyond the internal surface 24 of the cap holder 19, causing the internal surface of the resilient circular band 21 to hold the truncated conical portion 26' of a sealing cap second to the bottom 4' and making a convenient condition to take down a sealing cap 4 located at the extreme bottom of the sealing cap pile in the cap holder.

Figure 7:
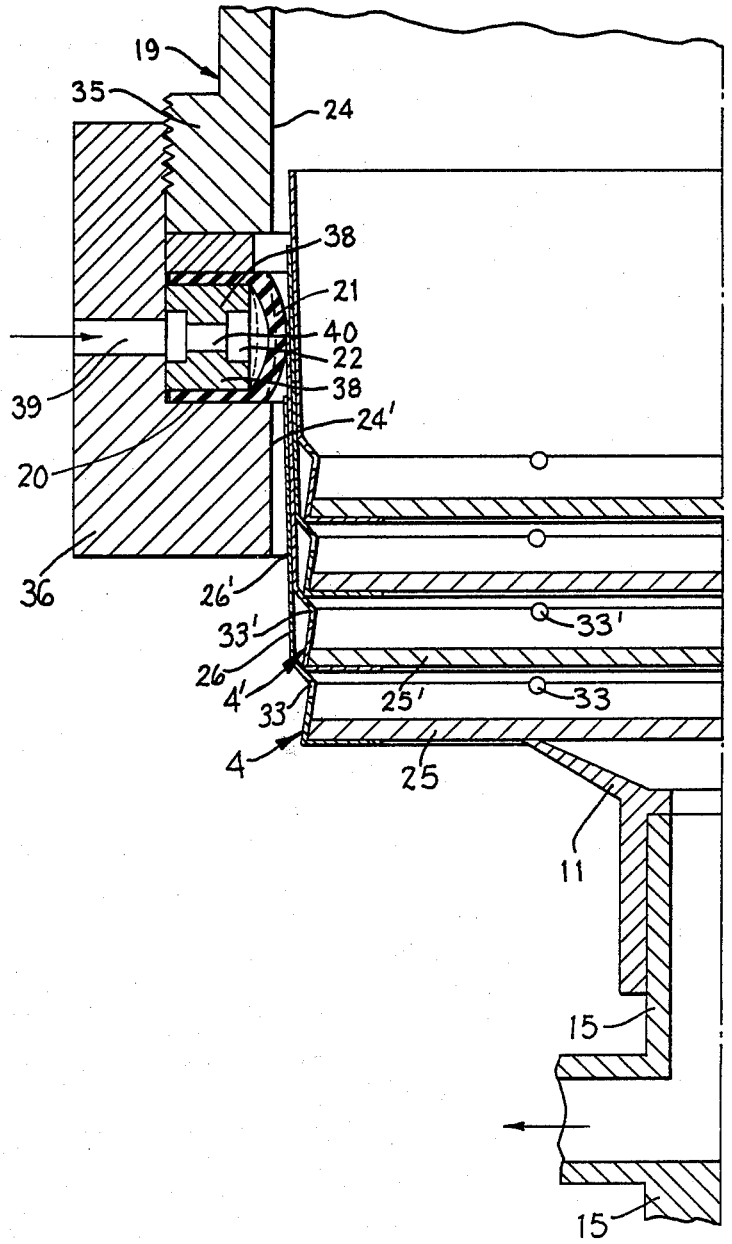
Figure 8:
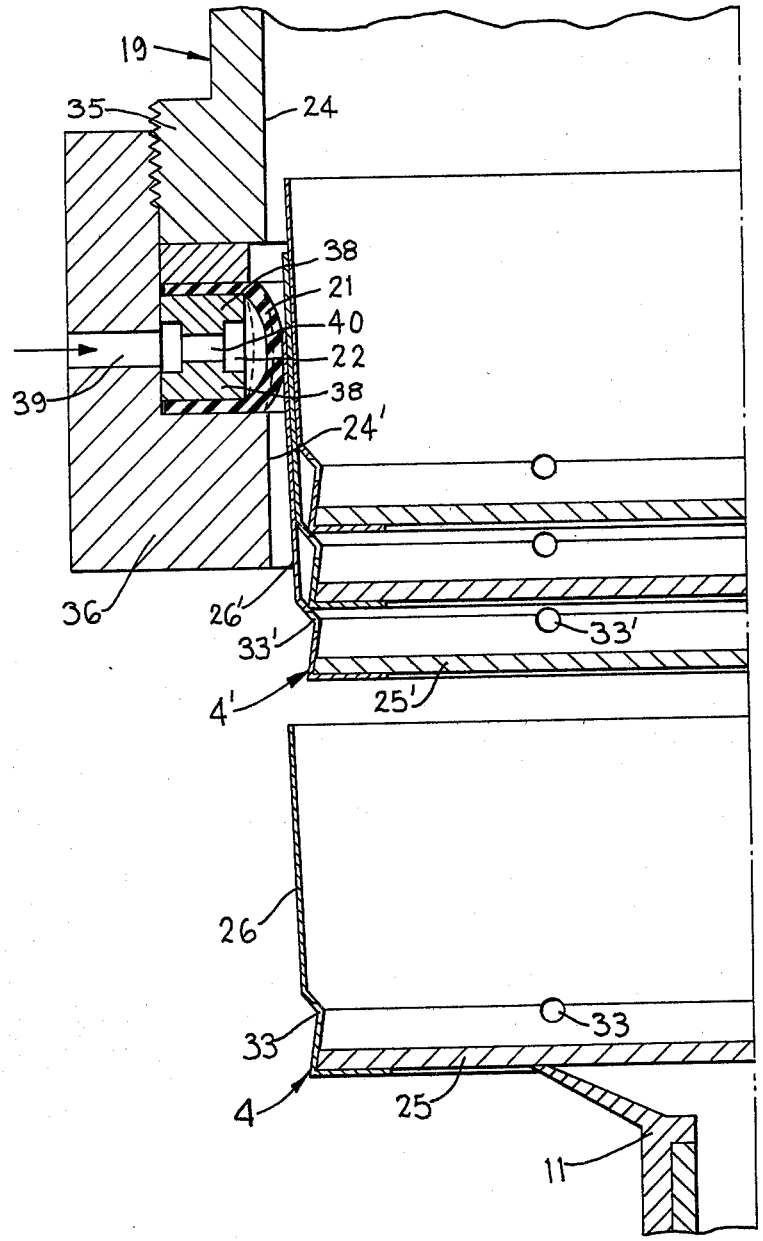

As seen from FIG. 7 illustrating the state of the cap pile being held by the holder 19, the hard head plate 25 of the cap 4 located at the extreme bottom of the cap pile does not engage the band 21 but is supported on the sucking member 11, while the soft side wall 26' of the cap 4' (second to the bottom cap 4) is held by the band 21 which, when air is supplied into the circular hollow space 22 of the holder 19, inflates toward the center thereof. As a result, even when the cap 4 is taken out of the holder 19, the other cap 4' and the cap pile heaped up thereon remain held and supported by the band 21. For the stack to be supported by holding of the side wall 26' requires the band 21 because the said wall 26', being made of thin soft pliable thermocontractive polyvinyl chloride, cannot be suitably held by means of a mechanical holding mechanism due to a tendency of side wall 26' to buckle or deform easily. The present invention overcomes this problem in that the resilient pressure fluid actuated band 21 presses inward against the pliable cap side wall with a circumferentially uniform pressure, applies this pressure over an axial extent of the cap side wall, provides for uniform frictional surface engagement with the cap side wall by reason of the resilient material of the band, engages the cap side wall other than just at the relatively flexible free edge thereof, and grips the portion of the cap side wall which is snugly radially backed by and thus stiffened by nested circumferential portions of the cylindrical side walls of adjacent caps in the stack.

The band 21, by being secured to cylindrical member 36 by means of annular member 38, except at its inner circular surface, eliminates the possibility of downward deformation of the band 21 when a load (the weight of a stack of caps) is applied thereto.

Adjacently to the cap holder 19, a printing member 29 is fitted to a rotary shaft 28 of a rotary air cylinder 27. A 180-degree rotation of the rotary air cylinder 27 allows the printing member 29 to print the date and/or some other indications on the sealing cap 4 located at the lowest in the cap holder. An ink pad 32 fitted on top of a rod 31 of an air cylinder 30 located at the right and downward position, is movable upward and downward by actuation of the air cylinder 30 and is allowed to add ink on the surface of the printing member 29. Nozzles are arranged at the front and upward position of the stopper 7 arranged along the conveyor 6 for spraying water for cleaning and for blowing air for drying bungs of draught beer barrels.

Figure 4A:
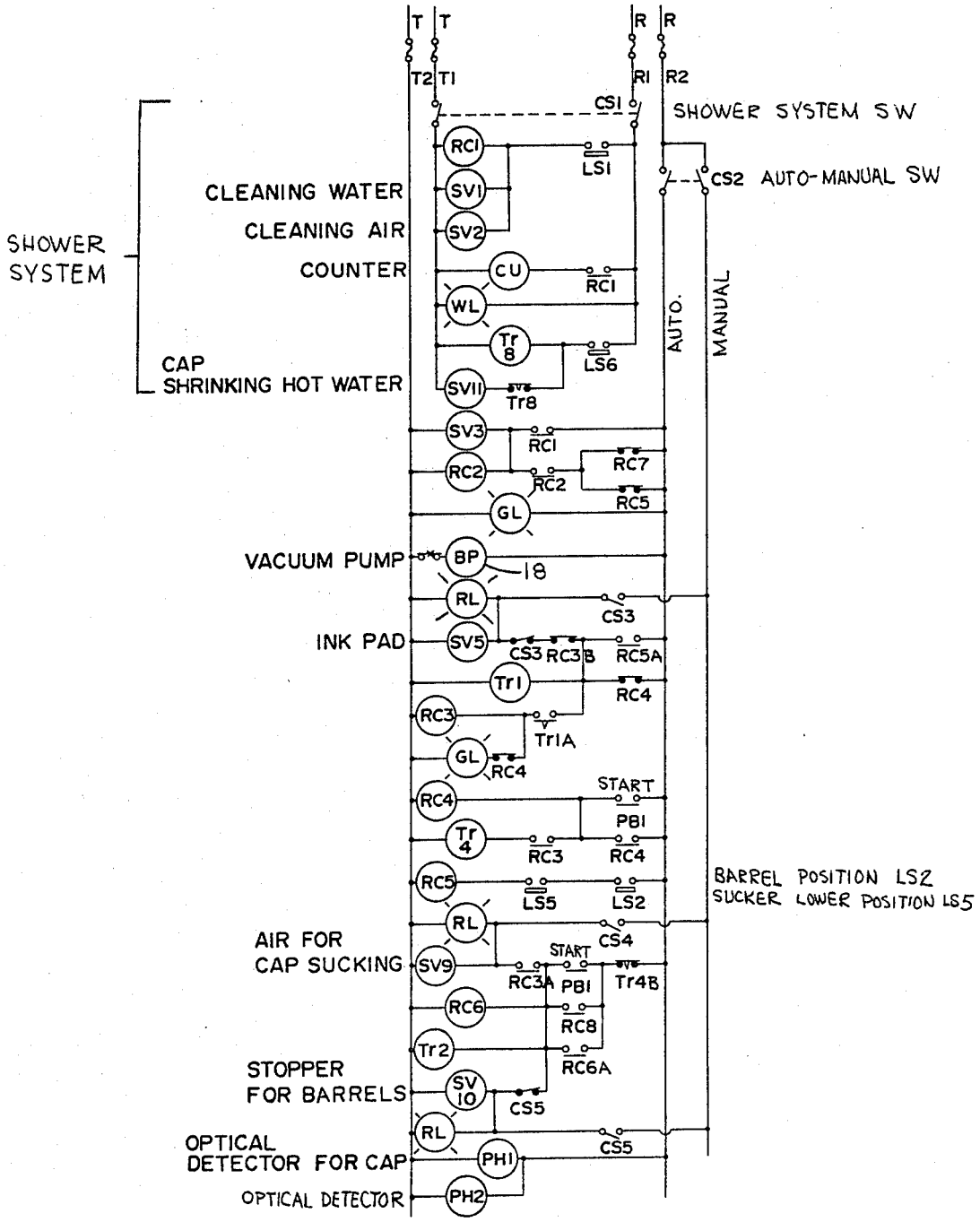
FIG. 4A is a portion of the wiring diagram for the embodiment in accordance with this invention shown in FIG. 2.
Figure 4B:
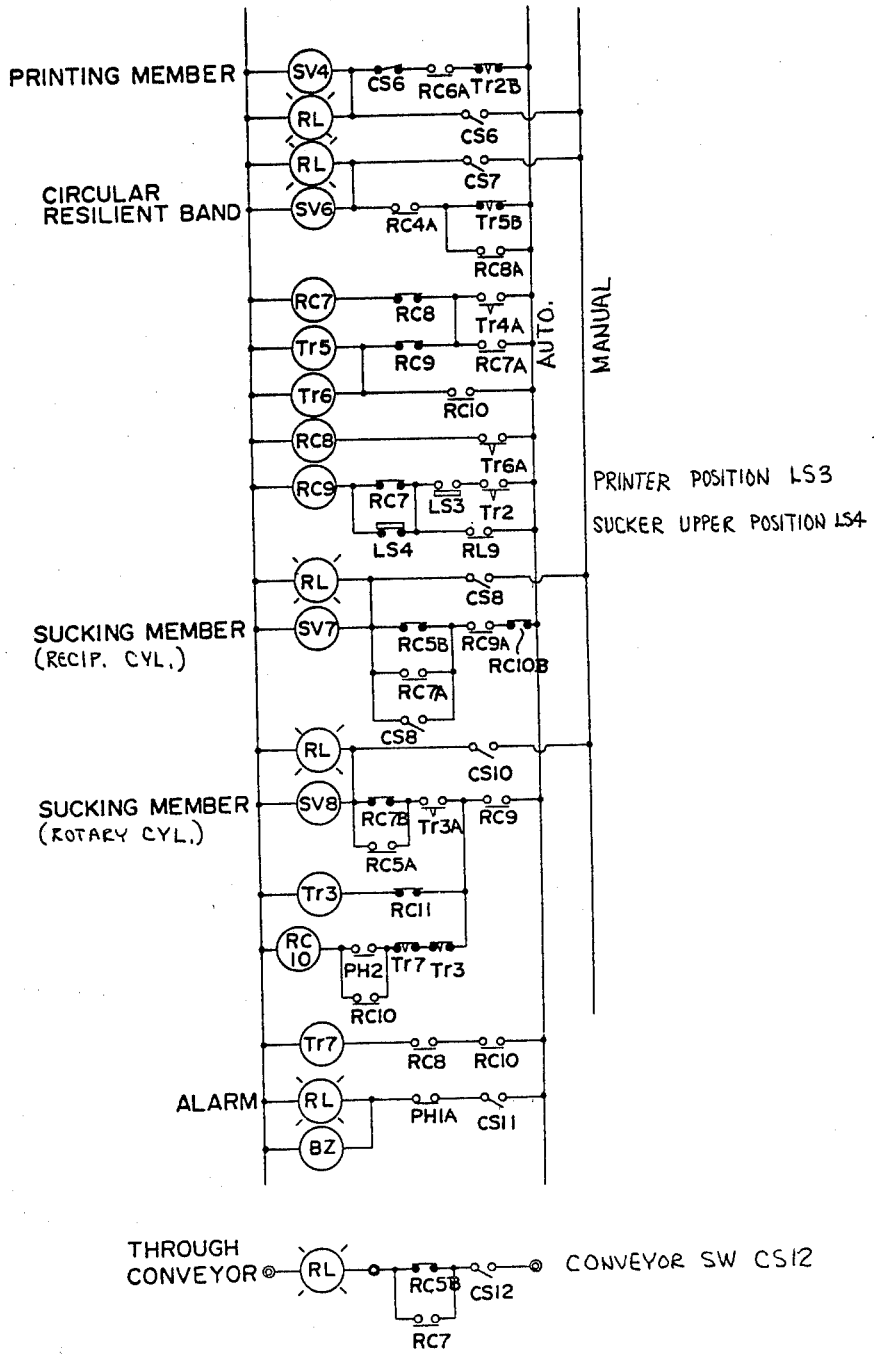
FIG. 4B is the remaining portion of the wiring diagram for the embodiment in accordance with this invention shown in FIG. 2.
Figure 9:
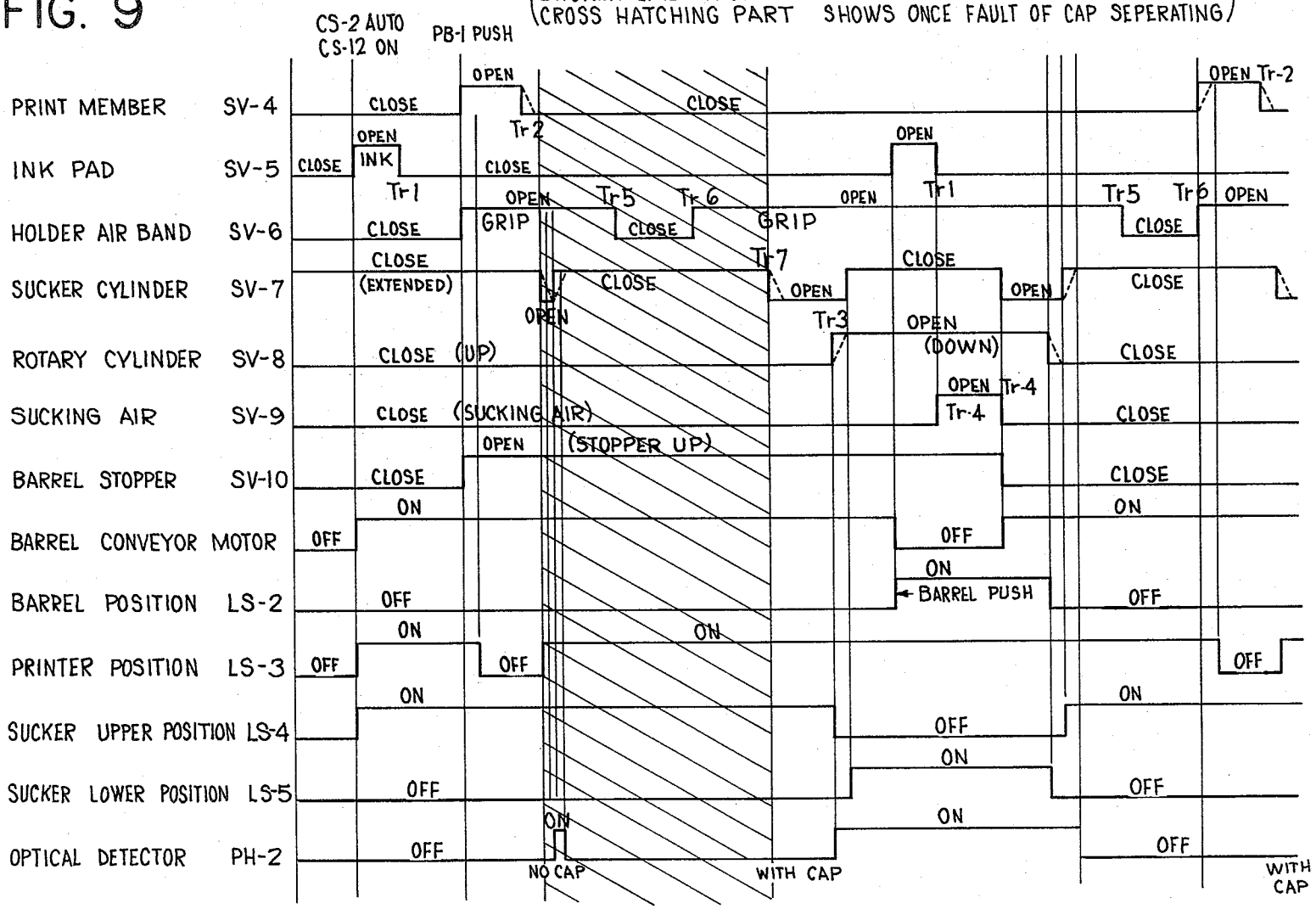
FIG. 9 is a diagram illustrating operating time sequences for major elements of the apparatus of FIGS. 2, 4A and 4B.

Referring to FIGS. 4A and 4B showing a typical wiring diagram to be employed for the embodiment in accordance with this invention shown in FIG. 2, and referring also to the circuitry time sequence chart of FIG. 9, the operation of the disclosed embodiment will be explained below. In the following discussion, specified contacts of mentioned relays, timers and the like will be referred to by the same reference character thereas with the suffix "A" added for normally open contacts and the suffix "B" added for normally closed contacts.

Manually actuable switches and indicator lamps (WL, RL, etc.) shown in FIGS. 4A and 4B may be displayed on a control panel (not shown) near the FIG. 2 apparatus.

The conductors T and R are connected to a suitable electric power source. Turning on the switch CS1 enables a shown system comprising relay RC1, limit switches LS1 and LS2, solenoid valves SV1, SV2 and SV11, counter CU, warning light WL and a timer Tr8. The shown system handles barrel cleaning prior to cap installation and shrinking of the installed cap 4 to seal same on the barrel.

Conveyor switch CS12 is turned on to start the barrel conveyor 6.

Selection of the automatic position for the automatic-manual switch CS2 allows a vacuum pump 18 to start rotation.

Figure 3:
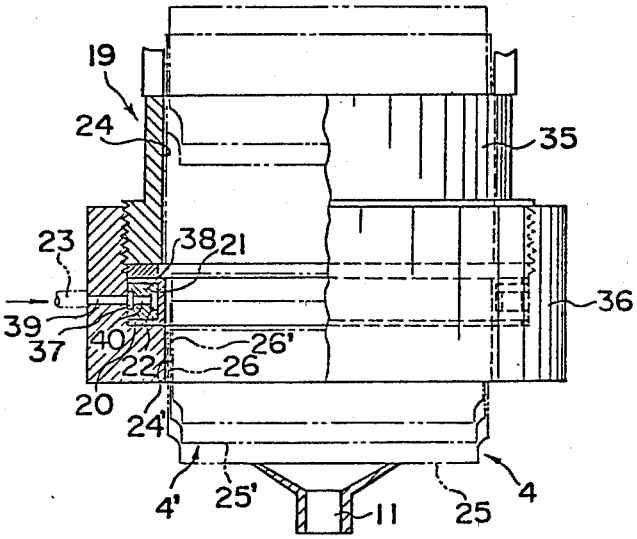
FIG. 3 is an enlarged partly cutaway view of a cap holder to be employed in the embodiment in accordance with this invention shown in FIG. 2.
Figure 5:
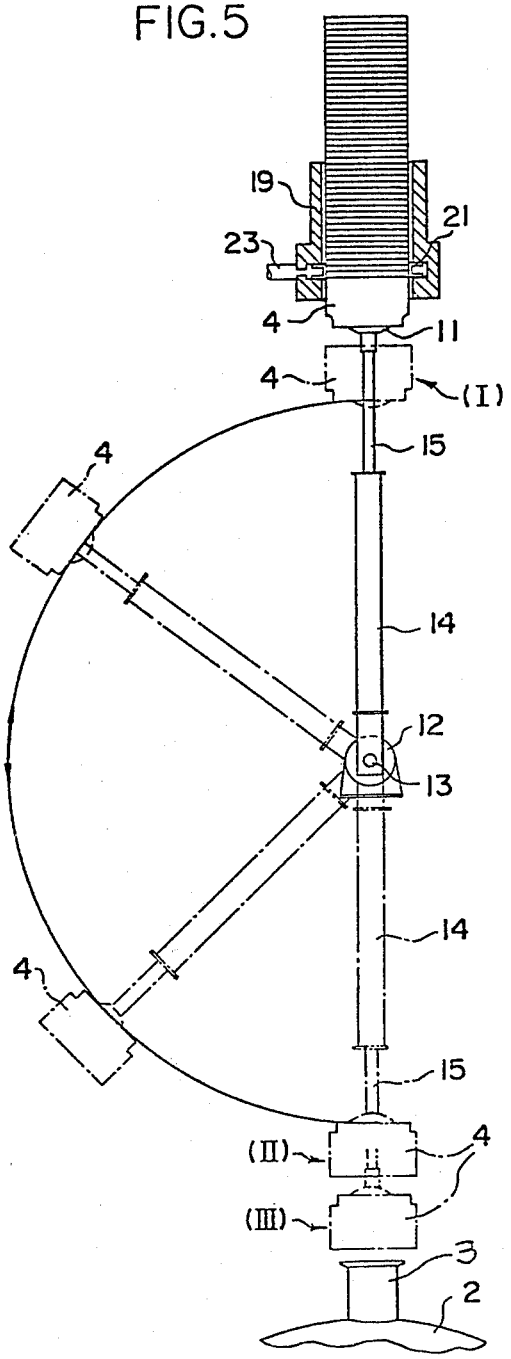
FIG. 5 is an enlarged diagrammatic elevational view of the cap transferring portion of the preferred embodiment as seen from the left in FIG. 2, FIGS. 6, 7 and 8 are enlarged fragments of FIG. 3 showing successive positions of the cap holder, stack of sealing caps and sucking member during removal of a cap from said cap holder.
Figure 6:
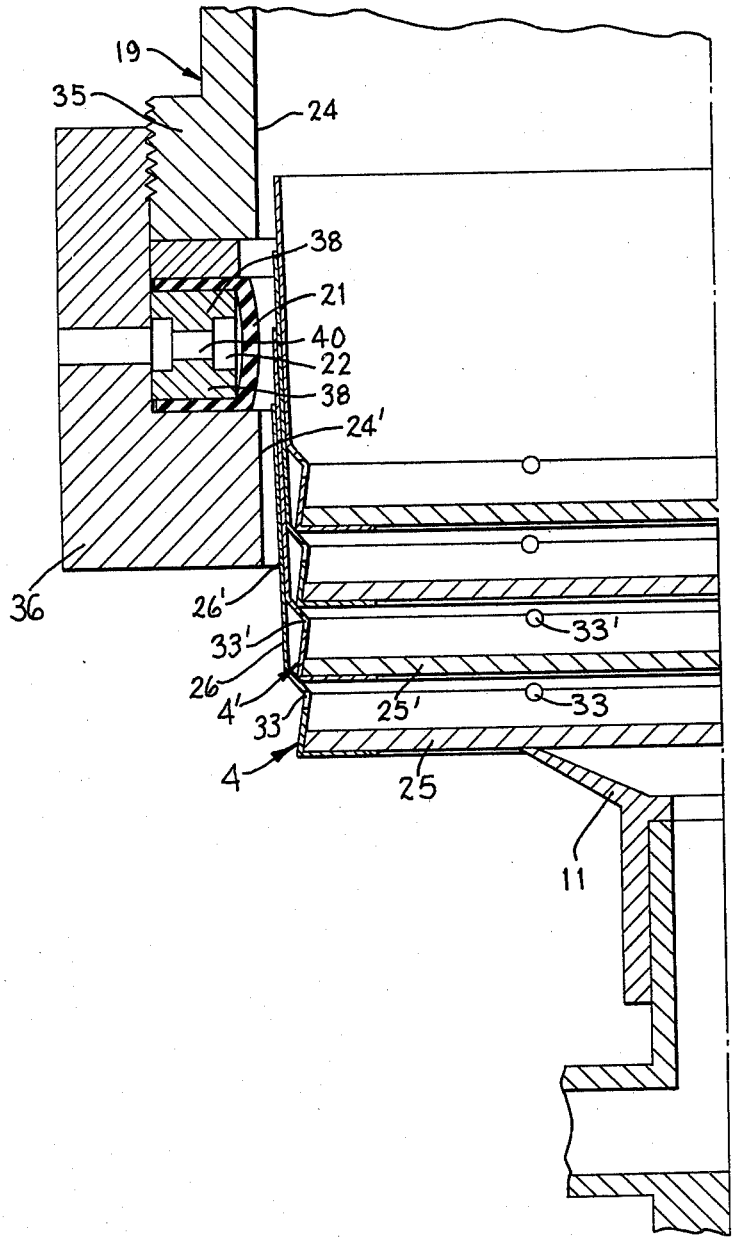

Preparation for the capping operation is completed by inserting, from above, a pile of caps 4 into the holder 19. FIGS. 3, 5 and 6 show the state of a cap pile in the holder 19 at this time, wherein a solenoid valve SV-6 is closed (off) and the connecting tube 23 of the holder communicates with the atmosphere so that the space 20 is kept at atmospheric pressure, which allows the band 21 to shrink owing to its own elasticity so that its surface may be in line with internal surfaces 24 and 24' of the holder 19. The small gap radially between the surface of the band 21 and the surface of the cap 4 permits the cap pile to slide down to its own weight within the holder 19. The head plate 25 of the lowermost cap 4 is supported by the sucking member 11 positioned therebeneath. In this position of the member 11, as seen in FIGS. 3, 5 and 6, the upper end edge of the side wall 26 of the lowermost cap 4 is positioned below the lower end edge of the band 21 and the upper portion of the side wall 26' of the cap positioned right above it engages the band 21.

The sucking member 11 is normally connected with the vacuum pump 18 in the de-energized condition of a solenoid valve SV-9. The member 11 is thus allowed to suck the cap 4, which state is shown in solid line in FIGS. 3, 5 and 6.

The printing member 29 stays in a waiting position as shown in FIG. 2. When a solenoid valve SV-5 opens, the air cylinder 30 causes the ink pad 32 to rise and add ink on the surface of the printing member 29. When a timer contact Tr-1A operates, a relay contact RC-3B opens the circuit to cause the solenoid valve SV-5 to close and the ink pad 32 to go down. The air cylinder 14 stays at the position shown in dotted line in FIG. 2, and in solid line in FIG. 5, with the sucking member 11 fitted to the rod 15 thereof staying at its upward waiting position. Since the solenoid valve SV-9 for suction and blow-off is closed, the sucking member 11 stays in its normal sucking condition.

Since the solenoid valve SV-10 is closed, the stopper for positioning the barrel stays below the conveyor surface of the conveyor 6.

When a start button PB-1 is pushed, relays RC-4 and RC-6 turn on, starting the automatic operation of the capping machine. When the relay contact RC-4A has made contact, the solenoid valve SV-6 opens to supply air pressure into the circular hollow space 22 formed by the circular recess 20 and the resilient circular band 21, causing the resilient circular band 21 to inflate toward the center thereof and the internal surface of the resilient circular band 21 to hold a sealing cap 4' second to the bottom as seen in FIG. 7.

When the relay contact RC-6A has made contact, the solenoid valve SV-4 opens, causing the air cylinder 27 to rotate the rotary shaft 28 attached with the printing member 29 by approximately 180 degrees and the lowest sealing cap 4 in the cap holder 19 to be printed with the date and/or some other indications. When a length of period set on the timer contact Tr-2B has expired, the solenoid valve SV-4 closes and the printing member 29 returns to the original position.

When the relay contact RC-6A has made contact, the solenoid valve SV-10 opens to actuate the air cylinder 8, causing the stopper 7 fitted at one end of the rod 9 to rise beyond the conveyor surface of the conveyor 6.

When the printing member 29 has returned to the original position and has pushed a limit switch LS-3, a relay contact RC-9A operates to open a solenoid valve SV-7, causing the sucking member 11, in suction engagement with the under surface of the sealing cap 4 located at the extreme bottom in the cap holder 19, to take such bottommost cap 4 downward out of the cap holder 19 as seen in FIG. 2 and in broken lines at I in FIG. 5. In this instance, the resilient circular band 21 keeps pressing against and thereby holding the side wall 26' of the sealing cap 4' second to the bottom, but the sealing cap 4 at the extreme bottom is left free to descend with piston rod 15.

If the sucking member 11 has failed to receive the sealing cap 4, an optical detector PH-2 (FIG. 4A) operates to cause the relay contact RC-10B to disconnect the circuit and the solenoid valve SV-7 to close. This causes the sucking member 11 to repeat the trial for taking a sealing cap out of the cap holder 19 until a success.

In this connection, it is to be noted that the optical detector PH-2 illustrated herein is designed so that when the sucking member 11 is located at an elevated position detector PH-2 is shielded from the light by either the rod 15 of the air cylinder 14 or the cap 4, so as to be turned off, whereby the relay contact RC-10B is connected. Otherwise detector PH-2 receives the light, so as to be turned on, thereby disconnecting the relay contact RC-10B. This state is illustrated in the cross-hatched part of FIG. 9.

Providing that the sucking member 11 has certainly received a sealing cap 4, that the printing member has returned to the original position, and that a length of period set on a timer contact Tr-3A has expired, the solenoid valve SV-8 opens to cause the rotary cylinder 12 to rotate the rotary shaft 13 supporting the air cylinder 14 downward by approximately 180 degrees. This moves the sucking member 11 as well as a sealing cap 4 held thereby from the upward position (FIG. 5 at (I)) to the downward position (FIG. 5 at (II)), where the sucking member 11 will wait for a barrel 2 to come. Providing that the air cylinder 14 has operated a limit switch LS-5, that a barrel 2 has stopped in contact with the stopper 7, and that the barrel 2 has operated a limit switch LS-2, a relay contact RC-5B disconnects the circuit to stop the conveyor 6.

When a relay contact RC-5A has operated, the solenoid valve SV-5 opens to cause the air cylinder 30 to make an upward motion for allowing the ink pad 32 to add ink on the surface of the printing member 29. When a length of period set on a timer contact TR-1A has expired, the relay contact RC-3B disconnects the circuit to close the solenoid valve SV-5, causing the air cylinder 30 to lower the ink pad 32 supported on one end of a rod 31 thereof. Since this operation of relay RC-5 disconnects its contact RC-5B, the solenoid valve SV-7 closes to cause the air cylinder 14 to lower (to its FIG. 5 (III) position) the sucking member 11 fitted at one end of the rod 15 thereof. Providing that the aforementioned relay contact RC-5A has operated and that relay contact RC-3A had operated after the length of period set on the timer Tr-1 expired, the solenoid valve SV-9 opens to blow air out of the sucking member 11 to apply a sealing cap 4 onto the bung 3 of a barrel 2. When a timer contact Tr-4B (in series with solenoid valve SV-9) has disconnected the circuit after a length of period set on such timer Tr-4 expires, the solenoid valve SV-9 closes to once again reduce the internal pressure of the sucking member 11, and the solenoid valve SV-10 causes the air cylinder 8 to lower the stopper 7 fitted on the rod 9 thereof below the conveyor surface of the conveyor 6.

When the series timer contact Tr-4A has operated, a relay contact RC-7A makes contact to open the solenoid valve SV-7, causing the air cylinder 14 to raise the sucking member 11 fitted on one end of a rod 15 thereof. The conveyor 6 starts moving again.

When the conveyor 6 has started moving, the barrel 2 with a bung applied with a sealing cap thereto departs from the limit switch LS-2 and a relay contact RC-5A disconnects its circuit path to the solenoid valve SV-8. Since a relay contact RC-7B has already disconnected its circuit, the solenoid valve SV-8 closes to cause the rotary air cylinder 12 to upwardly rotate the air cylinder 14 supporting the sucking member 11 at one end thereof, by 180 degrees to the position shown in FIG. 2 in dotted line and at FIG. 5(I). When the air cylinder 14 has come to contact with a limit switch LS-4, the relay contact RC-9A disconnects the circuit to close the solenoid valve SV-7, causing the air cylinder 14 to raise the sucking member 11 fitted at one end of the rod 15 thereof.

Providing that the relay contact RC-7A has made contact to energize timer Tr-5 and that a length of period set for a timer contact Tr-5B has expired, the solenoid valve SV-6 closes to make the internal pressure of the circular hollow space 22 formed by the circular recess 20 and the resilient circular band 21 an atmospheric pressure. As a result, the sealing cap 4' (previously second to the bottom in the cap holder 19 and now at the bottom due to the described removal of cap 4) is released from press-holding by band 21 and descends into contact with the raised sucking member 11 as seen in the solid line position of FIG. 5 and in FIG. 6. There the head plate 25' of the cap 4' contacts and is held by the sucking member as above discussed as to the first cap 4. Thereafter, when a timer contact Tr-6A has operated to allow a relay contact RC-8A to make contact, the solenoid valve SV-6 closes to supply air pressure into the circular hollow space 22 formed by the circular recess 20 and the resilient circular band 21, causing the resilient circular band 21 to hold a sealing cap 4' second to the bottom stored in the cap holder 19.

When the relay contact RC-6A has made contact to open the solenoid valve SV-4, the rotary air cylinder 27 is caused to rotate the printing member 29 fitted on one end of the rotary shaft 28 thereof by approximately 180 degrees, causing the printing member 29 to make printing on the lowest sealing cap 4 stored in the cap holder 19. When the length of period set on the timer Tr-2B has expired, the solenoid valve SV-4 disconnects the circuit to return the printing member 29 to the original position.

In accordance with the above-mentioned process, barrels 2, after being applied with sealing caps to the bungs thereof, are sent away by the conveyor 6. While they are conveyed by the conveyor 6, the limit switch LS-6 causes the solenoid valve SV-11 to in turn cause steam or hot water to be automatically sprayed on the sealing caps to cause the truncated conical portion thereof to shrink. This is effective to make the sealing tight and to sterilize the portion.

The above-mentioned process will be repeated to apply sealing caps 4 to the bungs of barrels 2 which are conveyed in sequence by a conveyor.

An optical detector PH-1A is provided to monitor the number of sealing caps 4 stored in the cap holder 19. A buzzer BZ provides an alarm, when the number of sealing caps 4 has reduced beyond a specific level, allowing a laborer to supplement the sealing caps 4 into the cap holder 19.

As mentioned earlier, the truncated conical portion of the sealing cap is joggled (stepped) at a portion close to the top thereof. This is effective to allow a sealing cap located at the lowest position in the cap holder to be taken down without fail during the period in which the sealing cap second to the bottom is held by a resilient circular band. Also as mentioned earlier, a plurality of air passages is arranged along the top end of the truncated conical portion of a sealing cap. This is effective to make it easy to take each sealing cap out of a sealing cap pile in the cap holder. Further, this is effective to prevent the head plate of a sealing cap from becoming uneven during the period in which steam or hot water is sprayed on a sealing cap, because hot air is readily discharged through the air passages.

Although but one embodiment of the present invention, specifically a capping machine for application of sealing caps with an overall shape of an upright truncated cone to the bungs of barrels for draught beer as incorporated in a product filling line, has been illustrated and described, it will be apparent to those skilled in the art that various changes and modifications may be made therein without departing from the spirit of the invention or from the scope of the appended claims.

The embodiments of the invention in which an exclusive property or privilege is claimed are defined as follows:

1. A capping machine for application of sealing caps to bungs of liquid containers, comprising:

a cap holder shaped to support a stack of sealing caps with substantially upwardly opening ends and having a resilient band contractable by pressure fluid to grip a sealing cap in said holder;

a sucking member normally actuated to grip by suction the under surface of a sealing cap located at the extreme bottom of the cap holder, said sucking member being movable to take down and hold same during the period in which the resilient band holds a sealing cap second to the bottom in the cap holder, said sucking member being alternately actuable to blow the cap off therefrom to facilitate depositing of the cap on a bung of a liquid container;

a reciprocating pressure fluid operated member for extending and retracting said sucking member;

a rotating pressure fluid actuated member for rotating said reciprocating pressure fluid actuated member from a location adjacent said stack of caps to a location adjacent said container;

a conveyor for advancing containers to be capped;

start means actuable for starting automatic operation of said capping machine;

first valve means responsive to actuation of said start means for contracting said band to hold said second sealing cap in said stack;

second valve means responsive to said actuation of said start means and coupled to a printing member for causing said printing member to apply a printed indicia to said bottom cap in said cap holder and then retracting said printing member to an out-of-the-way position;

third valve means additionally responsive to said actuation of said start means and coupled to a stopper adjacent said conveyor for causing said stopper to stop a container in a preselected position along the path of said conveyor;

fourth valve means responsive to said retraction of said printing member for retracting said reciprocating member and therewith said sucking member to remove said bottom cap from said stack;

optical detector means responsive to a failure of said sucking member to withdraw said bottom cap from said stack for recycling said fourth valve means and thereby causing said reciprocating member and sucking member to repeat their retraction and attempt to remove said bottom cap;

fifth valve means responsive to said withdrawal of said bottom cap from said stack for causing said rotating pressure fluid actuated member to rotate said reciprocating member and sucking member from adjacency with said stack of caps to adjacency with said stopped container;

sixth valve means responsive to said adjacency of said sucking member and container and cooperative with an inking device for causing said inking device to add ink to the surface of said printing member, and thereafter for changing the state of said fourth valve means to extend said reciprocating member and sucking member and for actuating a seventh valve means to supply blow-off air to said sucking member to deposit said bottom cap on a bung of the adjacent liquid container;

timing means cooperable with said seventh valve means for thereafter changing the state of said third valve means to retract said stopper out of the way of said container on said conveyor and for changing the state of said fourth valve means to retract said reciprocating member and sucking member from adjacency with said container while causing said conveyor to advance said container;

means responsive to such container advancement for changing the state of said fifth valve means to rotate said rotating member and thereby said reciprocating member back to adjacency with said stack in said holder;

means responsive to said last-mentioned adjacency for again changing the state of said fourth valve means to cause said reciprocating member to extend said sucking member into engagement with the second cap in said stack and means cooperable with said conveyor advance responsive means for thereafter changing the state of said first valve means to thereby permit expansion of said contractable band and release by said band of said second cap to permit said stack to descend onto said extended sucking member;

further timing means for thereafter returning said first valve means to its normal state to contact said resilient band and grip the third cap of said stack so as to condition the apparatus for capping a second container.

* * * * *